US007834866B2

(12) United States Patent
Ogawa

(10) Patent No.: US 7,834,866 B2
(45) Date of Patent: Nov. 16, 2010

(54) DISPLAY PANEL DRIVER AND DISPLAY PANEL DRIVING METHOD

(75) Inventor: Yasunori Ogawa, Tokyo (JP)

(73) Assignee: NEC Viewtechnology, Ltd., Tokyo (JP)

( * ) Notice: Subject to any disclaimer, the term of this patent is extended or adjusted under 35 U.S.C. 154(b) by 906 days.

(21) Appl. No.: 11/445,170

(22) Filed: Jun. 2, 2006

(65) Prior Publication Data

US 2007/0008264 A1 Jan. 11, 2007

(30) Foreign Application Priority Data

Jul. 6, 2005 (JP) ..... 2005-197577

(51) Int. Cl.
*G09G 5/00* (2006.01)

(52) U.S. Cl. ..... 345/204; 345/99; 345/213; 345/3.2; 348/441; 348/458

(58) Field of Classification Search ..... 345/87, 345/213, 99, 204, 3.2; 348/441, 458
See application file for complete search history.

(56) References Cited

U.S. PATENT DOCUMENTS 4,100,575 A * 7/1978 Morio et al. ..... 380/204
4,390,898 A * 6/1983 Bond et al. ..... 380/214
4,454,543 A * 6/1984 Lund et al. ..... 380/206
4,594,609 A * 6/1986 Romao et al. ..... 380/218
4,673,981 A * 6/1987 Lippman et al. ..... 348/441
4,896,337 A * 1/1990 Bushy, Jr. ..... 375/371
4,914,694 A * 4/1990 Leonard et al. ..... 380/204
5,036,216 A * 7/1991 Hohmann et al. ..... 327/157
5,325,179 A * 6/1994 Azar et al. ..... 348/443
5,818,416 A * 10/1998 Hwang ..... 345/667
5,859,626 A * 1/1999 Kawamura ..... 345/99

(Continued)

FOREIGN PATENT DOCUMENTS

JP 5-227453 9/1993

(Continued)

OTHER PUBLICATIONS

Sunplus Technology Co., Ltd.: "SPCA711A Digital Video Encoder for Video CD Datasheet" Dec. 5, 2000, , pp. 4 and 8.*

(Continued)

*Primary Examiner*—Richard Hjerpe
*Assistant Examiner*—Dorothy Webb
(74) *Attorney, Agent, or Firm*—McGinn IP Law Group, PLLC

(57) ABSTRACT

A display panel driver includes: a clock generator for generating a clock signal; a horizontal reference generating circuit having a first frequency divider for dividing the frequency of the clock signal; a vertical reference generating circuit having a second frequency divider for dividing the frequency of the output from the first frequency divider; a switch circuit having one input terminal to which an external vertical synchronizing signal is supplied and having another input terminal to which the output signal from the second frequency divider is supplied and which selectively output one of said input terminals; and a CPU that alters the oscillation frequency of the clock generator or the frequency division ratio at the first frequency divider when a switching between the input terminals of the switch circuit is performed.

12 Claims, 5 Drawing Sheets

U.S. PATENT DOCUMENTS

| | | | | |
|---|---|---|---|---|
| 6,288,748 | B1 * | 9/2001 | Watanabe et al. | 348/511 |
| 6,316,974 | B1 * | 11/2001 | Taraci et al. | 327/147 |
| 6,515,708 | B1 * | 2/2003 | Kato | 348/524 |
| 6,549,240 | B1 * | 4/2003 | Reitmeier | 348/459 |
| 7,312,793 | B2 | 12/2007 | Chida | |
| 7,548,233 | B1 * | 6/2009 | Lee et al. | 345/204 |
| 2004/0001414 | A1 * | 1/2004 | Kadowaki et al. | 369/59.24 |
| 2004/0012578 | A1 * | 1/2004 | Naegle | 345/204 |
| 2005/0057551 | A1 * | 3/2005 | Gong et al. | 345/211 |
| 2006/0077288 | A1 * | 4/2006 | Wu | 348/441 |

FOREIGN PATENT DOCUMENTS

| | | |
|---|---|---|
| JP | 6-18843 | 1/1994 |
| JP | 8-140019 | 5/1996 |
| JP | 2000-165782 | 6/2000 |
| JP | 2000-305061 | 11/2000 |
| JP | 2001-78053 | 3/2001 |
| JP | 2002-287689 | 10/2002 |
| JP | 2002-341851 | 11/2002 |
| JP | 2004-86146 | 3/2004 |
| JP | 2004-151222 | 5/2004 |
| JP | 2004-198769 | 7/2004 |
| JP | 2004-206075 | 7/2004 |
| JP | 2005-18085 | 1/2005 |
| JP | 2005-27195 | 1/2005 |
| JP | 2005-86302 | 3/2005 |
| JP | 2005-99516 | 4/2005 |
| WO | WO 02/32116 | 4/2002 |
| WO | WO 0232116 A1 * | 4/2002 |

OTHER PUBLICATIONS

European Search Report dated Sep. 30, 2008.

"SAA7185 Digital Video Encoder (DENC2) Data Sheet" Jul. 8, 1996, Philips Electronics N.V., XP002494491, p. 8, col. 2 -p. 9, col. 1.

"SPCA711A Digital Video Encoder for Video CD Datasheet" Dec. 5, 2000, Sunplus Technology Co., XP00249442, p. 8.

Japanese Office Action dated Dec. 9, 2009 with English translation thereof.

* cited by examiner

Fig. 4

| | RCK | 1／M frequency divider | RHD | 1／N frequency divider | Vertical reference generating circuit output VDR | Vsync VDI | Vertical reference signal RVD | Line count RHD／RVD |
|---|---|---|---|---|---|---|---|---|
| ① | 75.8MHz | 1170 | 64.8kHz | 1080 | 60Hz | 62.7Hz | 60Hz | 1080 |
| ② | 75.8MHz | 1170 | 64.8kHz | 1080 | 60Hz | 62.7Hz | 62.7Hz | 1033 |
| ③ | 75.8MHz | 1122 | 67.7kHz | 1080 | 62.7Hz | 62.7Hz | 62.7Hz | 1080 |
| ④ | 79.2MHz | 1170 | 67.7kHz | 1080 | 62.7Hz | 62.7Hz | 62.7Hz | 1080 |

DISPLAY PANEL DRIVER AND DISPLAY PANEL DRIVING METHOD

BACKGROUND OF THE INVENTION (1) Field of the Invention

The present invention relates to a display panel driver and a driving method for display devices represented by liquid crystal displays and plasma displays.

(2) Description of the Related Art

There have been known liquid crystal display devices that display an image on a liquid crystal display panel in accordance with a video signal supplied from an external apparatus (see Japanese Patent Application Laid-open 2004-151222). In a liquid crystal display device of this kind, the video signal supplied externally is converted into digital signals, then stored temporarily in a memory. Then, data is read out from the memory in response to a predetermined timing signal and supplied to a driver circuit of the liquid crystal display panel. The timing signal required to drive the liquid crystal display panel is generated based on a horizontal reference signal (a signal that specifies the display period of one scan line or horizontal line that constitutes an image frame) and a vertical reference signal (a signal that specifies the vertical period or the display period of one image frame) which are generated internally.

In the aforementioned display device, however, if the frequency of the vertical reference signal varies, a discontinuity takes place in the drive timing signal for driving the liquid crystal display panel. As a result, the number of horizontal lines (scan lines) during one vertical period changes, causing the problem that a stable image display becomes impossible.

As an example where the frequency of the vertical reference signal changes, a case as follows can be considered.

When an external image signal (especially for motion pictures such as a video signal) is stored into a memory (e.g., field memory) and data is read out from the memory upon a predetermined timing signal, writing data into the memory is performed based on a vertical synchronizing signal externally supplied. In contrast, reading data from the memory is preformed based on a vertical reference signal which is generated based on an internal clock which is asynchronous with the external vertical synchronizing signal. Accordingly, there occur some cases where the timing of reading data outpaces the timing of writing data, other cases where the timing of reading data is outpaced by the timing of writing data. In such a case, if there is a time lag between the write frame and the read frame (that is, in a case where a motion picture is handled), there occurs a problem that the display image is shifted sidewards. To deal with this, there is a need for suppressing the occurrence of a sideward image shift by adjusting the timing of writing data into the memory and the timing of reading data from the memory. An adjustment method has been known, in which the vertical reference signal, based on which timing signal for data reading and timing signal for driving the liquid crystal panel are determined, is switched into a signal which is synchronized with the external video signal, i.e., the vertical synchronizing signal which is externally supplied. In this case, a change in the frequency of the vertical reference signal occurs when the vertical reference signal generated within is switched into the vertical synchronizing signal from without.

Further, while the external vertical synchronizing signal is being used as a vertical reference signal in the aforementioned adjustment method, functions such as fast forward play, rewinding play, etc., are performed on a VTR (video tape-recorder) as an external apparatus, the frequency of the synchronizing signal (vertical synchronizing signal) from the VTR changes, with the result that the frequency of the vertical reference signal changes.

SUMMARY OF THE INVENTION

The object of the present invention is to provide a display panel driver which can solve the above problem and keep the number of scan lines displayed during one vertical period constant even if the frequency of the vertical reference signal varies.

In order to achieve the above object, in the present invention a display panel driver for a display panel on which an image frame is formed of a plurality of scan lines, includes: a drive timing signal generating circuit for generating a drive timing signal for driving the display panel based on a horizontal reference signal that will be the reference of the display period of every scan line and a vertical reference signal that will be the reference of the vertical period as the display period of the image frame; and a controller which, when the frequency of the vertical reference signal has changed, calculates the frequency of the horizontal reference signal that can keep the number of scan lines to be displayed during one vertical period at a predetermined count based on the frequency of the changed vertical reference signal and controls the frequency of the horizontal reference signal so as to be equal to the calculated frequency.

According to this configuration, when the vertical reference signal has been switched to an external vertical synchronizing signal, or when the frequency of the synchronizing signal (vertical synchronizing signal) from a VTR has changed, the controller changes the frequency of the horizontal reference signal in conformity with changes in the frequency, so that the number of scan lines during one vertical period can always be kept at a predetermined count without causing any discontinuity in the drive timing signal for driving the display panel.

According to the present invention, since the number of scan lines during one vertical period can always be kept at a predetermined count even if the frequency of the vertical reference signal varies, it is possible to provide a stable liquid crystal panel drive.

The above and other objects, features, and advantages of the present invention will become apparent from the following description with reference to the accompanying drawings which illustrate examples of the present invention.

BRIEF DESCRIPTION OF THE DRAWINGS

In the accompanying drawing(s):

FIG. 4 is a chart for explaining the horizontal frequency control process performed in the horizontal/vertical reference signal generating circuit shown in FIG. 1;

DETAILED DESCRIPTION OF THE PREFERRED EMBODIMENT(S)

Figure 1:
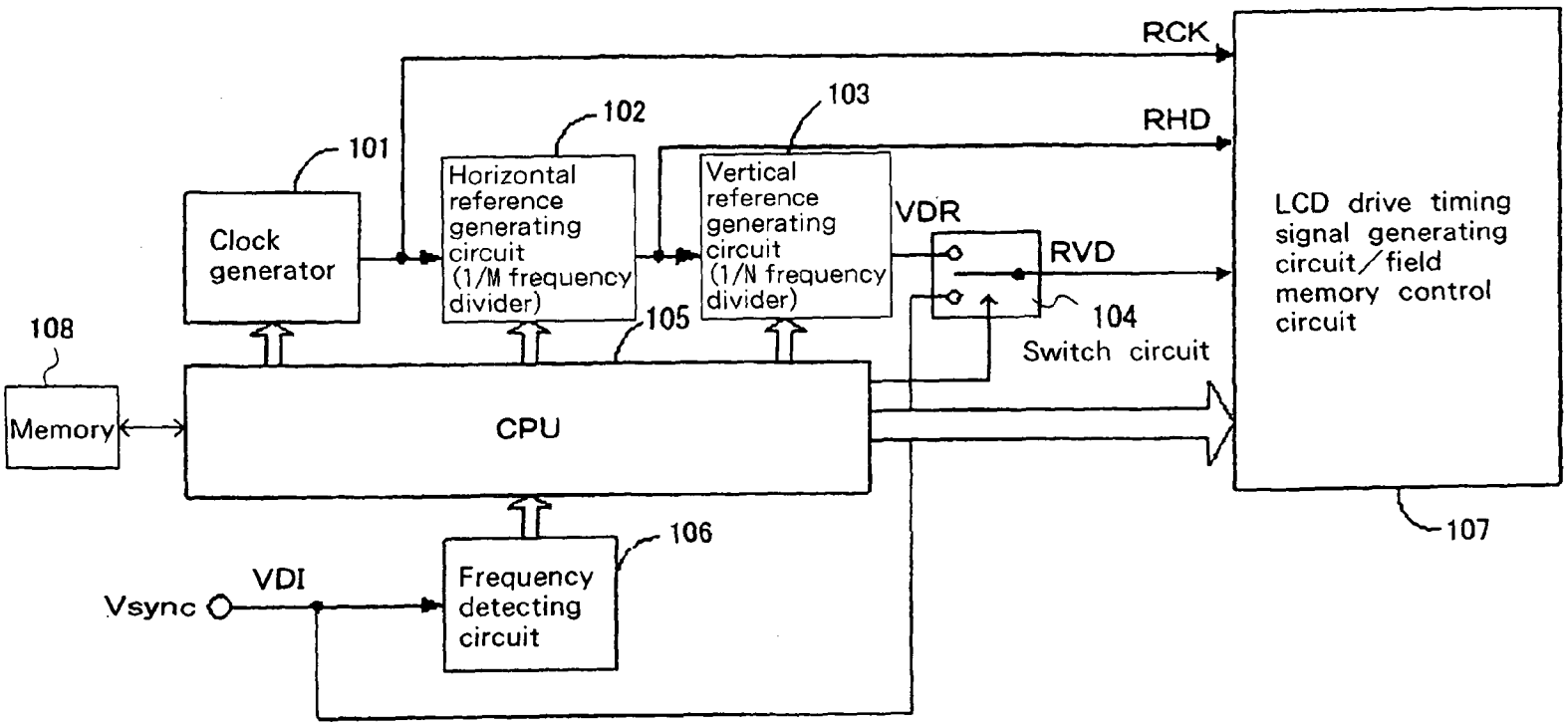
FIG. 1 is a block diagram showing a configuration of a horizontal/vertical reference signal generating circuit for a liquid crystal drive circuit as one embodiment of the present invention.
Figure 2:
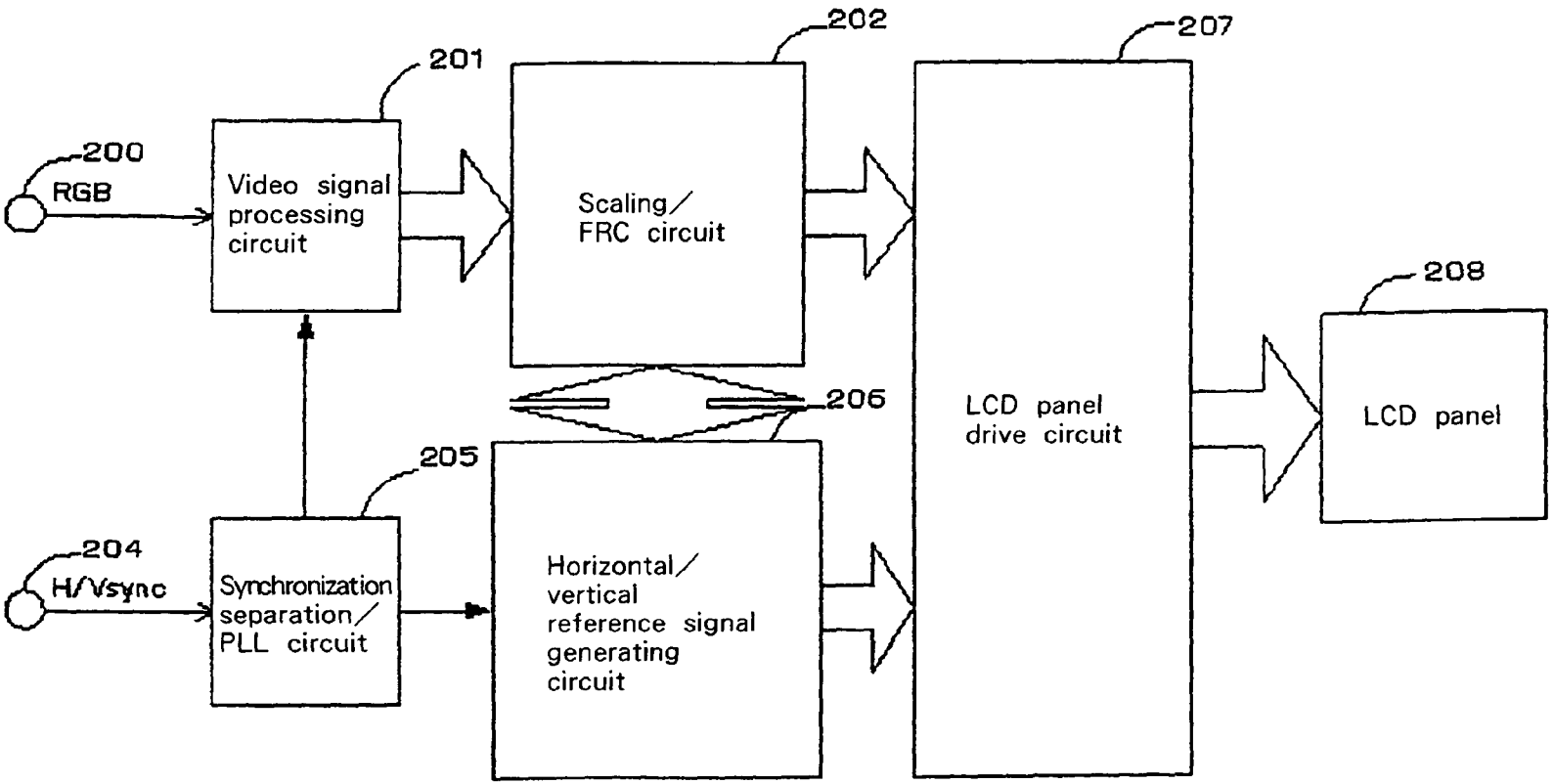
FIG. 2 is a block diagram showing an overall configuration of a liquid crystal drive circuit having the horizontal/vertical reference signal generating circuit shown in FIG. 1.

FIG. 1 is a block diagram showing a configuration of a horizontal/vertical reference signal generating circuit as a characteristic portion of a liquid crystal drive circuit of one embodiment of the present invention. FIG. 2 is a block diagram showing an overall configuration of a liquid crystal drive circuit having the horizontal/vertical reference signal generating circuit shown in FIG. 1.

To begin with, referring to FIG. 2, the configuration of a liquid crystal drive circuit of the present embodiment will be described. The liquid crystal drive circuit of the present embodiment includes: as shown in FIG. 2, video signal processing circuit 201; scaling (resolution converting)/FCR (frame rate converter) circuit 202; synchronization separation/PLL circuit 205; horizontal/vertical reference signal generating circuit 206; and liquid crystal panel drive circuit 207.

Video signal processing circuit 201 is connected to input terminal 200 to which a video signal (analog RGB signal) is supplied from an external appliance (television receiver, video appliance, computer unit or the like), and has an A/D converter for converting the video signal supplied via this input terminal 200 into a digital signal. The video data that has been converted by video signal processing circuit 201 is supplied to scaling/FCR circuit 202. The operation of video signal processing circuit 201 is synchronized with a system clock that is supplied from synchronization separation/PLL circuit 205.

Scaling/FCR circuit 202 has a field memory for storing video data from video signal processing circuit 201, and obtains video data that has a frequency and resolution (the number of pixel data) suitable for driving liquid crystal panel 208 by controlling writing and reading of data in this field memory.

Synchronization separation/PLL circuit 205 is connected to input terminal 204 to which synchronizing signals (H/Vsync) are externally supplied, and generates synchronizing signals suitable for driving subsequent circuits and a system clock that will be required for subsequent circuits, based on the synchronizing signals (H/Vsync) supplied via this input terminal 204.

Horizontal/vertical reference signal generating circuit 206, based on the synchronizing signal supplied from synchronization separation/PLL circuit 205, generates a horizontal reference signal and a vertical reference signal which comprise a reference signal for operating scaling/FCR circuit 202 and liquid crystal panel driving circuit 207.

Liquid crystal panel driving circuit 207, based on the timing signal containing the horizontal reference signal and vertical reference signal from horizontal/vertical reference signal generating circuit 206, generates a drive timing signal required for driving liquid crystal panel 208, and converts the video data (digital signal) from scaling/FCR circuit 202 into an analog video signal suitable for display on liquid crystal panel 208.

In the liquid crystal drive circuit of the present embodiment, the video signal supplied via input terminal 200 is converted into a digital signal through video signal processing circuit 201, then the digital signal is converted into video data having a frequency and resolution (number of pixel data) suitable for driving liquid crystal panel 208 by scaling/FCR circuit 202 so as to be supplied to liquid crystal panel driving circuit 207. In liquid crystal panel driving circuit 207, the video data from scaling/FCR circuit 202 is converted into an analog video signal suitable for display on liquid crystal panel 208 while a drive timing signal is generated based on the timing at which the horizontal reference signal and vertical reference signal are supplied from horizontal/vertical reference signal generating circuit 206. Liquid crystal panel 208 is driven based on the drive timing signal generated by this liquid crystal panel driving circuit 207 so that an image is displayed on liquid crystal panel 208 in accordance with the analog video signal. In this sequence of operation processing, if the vertical frequency of the drive timing signal for liquid crystal panel 208 changes, horizontal/vertical reference signal generating circuit 206 adjusts the horizontal frequency in response to the varied vertical frequency so as to keep the number of horizontal synchronization signals (those corresponding to the so-called line count or the number of scan lines) constant. With this arrangement, when the vertical frequency of the drive timing signal of liquid crystal panel 208 has varied, it is possible to suppress any discontinuity from taking place in the drive timing signal so as to realize stable operation of liquid crystal panel 208.

Referring next to FIG. 1, the configuration of horizontal/vertical reference signal generating circuit 206 as a characteristic portion of a liquid crystal drive circuit of the present invention will be specifically described.

Referring to FIG. 1, horizontal/vertical reference signal generating circuit 206 includes clock generator 101, horizontal reference generating circuit 102, vertical reference generating circuit 103, switch circuit 104, CPU 105, frequency detecting circuit 106, liquid crystal drive timing signal generating circuit/field memory control circuit 107 and memory 108.

Clock generator 101 is to generate signal processing clock RCK whose oscillation frequency is variable. Signal processing clock RCK output from clock generator 101 is supplied to horizontal reference generating circuit 102 and to liquid crystal drive timing signal generating circuit/field memory control circuit 107.

Horizontal reference generating circuit 102 is formed of a 1/M frequency divider for dividing signal processing clock RCK supplied from clock generator 101 by M and outputs the output of the 1/M frequency divider as horizontal reference signal RHD. The frequency division ratio (M value) at the 1/M frequency divider is variable. Horizontal reference signal RHD output from horizontal reference generating circuit 102 is supplied to vertical reference generating circuit 103 and to liquid crystal drive timing signal generating circuit/field memory control circuit 107.

Vertical reference generating circuit 103 is formed of a 1/N frequency divider for dividing horizontal reference RHD supplied from horizontal reference generating circuit 102 by N and outputs the output of the 1/N frequency divider as vertical reference signal VDR. The frequency division ratio (N value) at 1/N frequency divider is fixed.

Switch circuit 104 has one input terminal to which vertical reference signal VDR from vertical reference generating circuit 103 is supplied and has another input terminal to which vertical synchronizing signal Vsync, which is supplied from synchronization separation/PLL circuit 205 shown in FIG. 2, as external vertical synchronizing signal VDI. In Switch circuit 104, one of these input terminals is selected in accordance with the control signal from CPU 105. The output from switch circuit 104 is supplied as vertical reference signal RVD to liquid crystal drive timing signal generating circuit/field memory control circuit 107.

Frequency detecting circuit 106 detects the frequency of external vertical synchronizing signal VDI from synchronization separation/PLL circuit 205. Liquid crystal drive timing signal generating circuit/field memory control circuit 107, based on signal processing clock RCK, horizontal reference signal RHD and vertical reference signal RVD, generates timing signals for writing and reading data in the field memory in scaling/FCR circuit 202 shown in FIG. 2, and generates timing signals that will be required for driving liquid crystal panel 208 shown in FIG. 2.

CPU 105 performs control (including synchronization control) of the operations at clock generator 101, horizontal reference generating circuit 102, vertical reference generating circuit 103, switch circuit 104 and liquid crystal drive timing signal generating circuit/field memory control circuit 107. CPU 105 also performs input switching control at switch circuit 104 and performs a process (horizontal frequency control process) for varying the frequency of horizontal reference signal RHD in accordance with the change in the frequency of vertical reference signal RVD that occurs accompanied by input switching control.

Memory 108 stores information required for the horizontal frequency control process such as a set value M (variable) for the frequency division ratio at the 1/M frequency divider of horizontal reference generating circuit 102, a set value N (fixed) for the frequency division ratio at the 1/N frequency divider of vertical reference generating circuit 103, the oscillation frequency of clock generator 101 (the frequency of signal processing clock RCK) and the like. In the present embodiment, memory 108 has set values M and N for frequency division ratios at the 1/M frequency divider and at the 1/N frequency divider and the frequency of signal processing clock RCK, previously stored therein as default values.

In the thus configured horizontal/vertical reference signal generating circuit 206, CPU 105 controls the switching between the input terminals of switch circuit 104 in order to suppress occurrence of the aforementioned sideward shift. Specifically, CPU 105 periodically controls the switching between the first state in which vertical reference signal VDR is selected as input to switch circuit 104 and the second state in which external vertical synchronizing signal VDI is selected as input to switch circuit 104.

When the above state switching control (in which CPU 105 controls the switching between input terminals of switch circuit 104) is performed, the frequency of vertical reference signal RVD changes, with the result that horizontal reference signal RHD and vertical reference signal RVD become asynchronized, so that the number of the horizontal reference signals during one vertical period, i.e., the number of lines (="horizontal reference signal RHD"/"vertical reference signal RVD") varies. To deal with this, in the present embodiment when CPU 105 performs the state switching control (the switching between the input terminals of switch circuit 104), it also performs a horizontal frequency control process for varying the frequency of horizontal reference signal RHD in accordance with the change in the frequency of vertical reference signal RVD accompanied by the input switching control.

Figure 3:
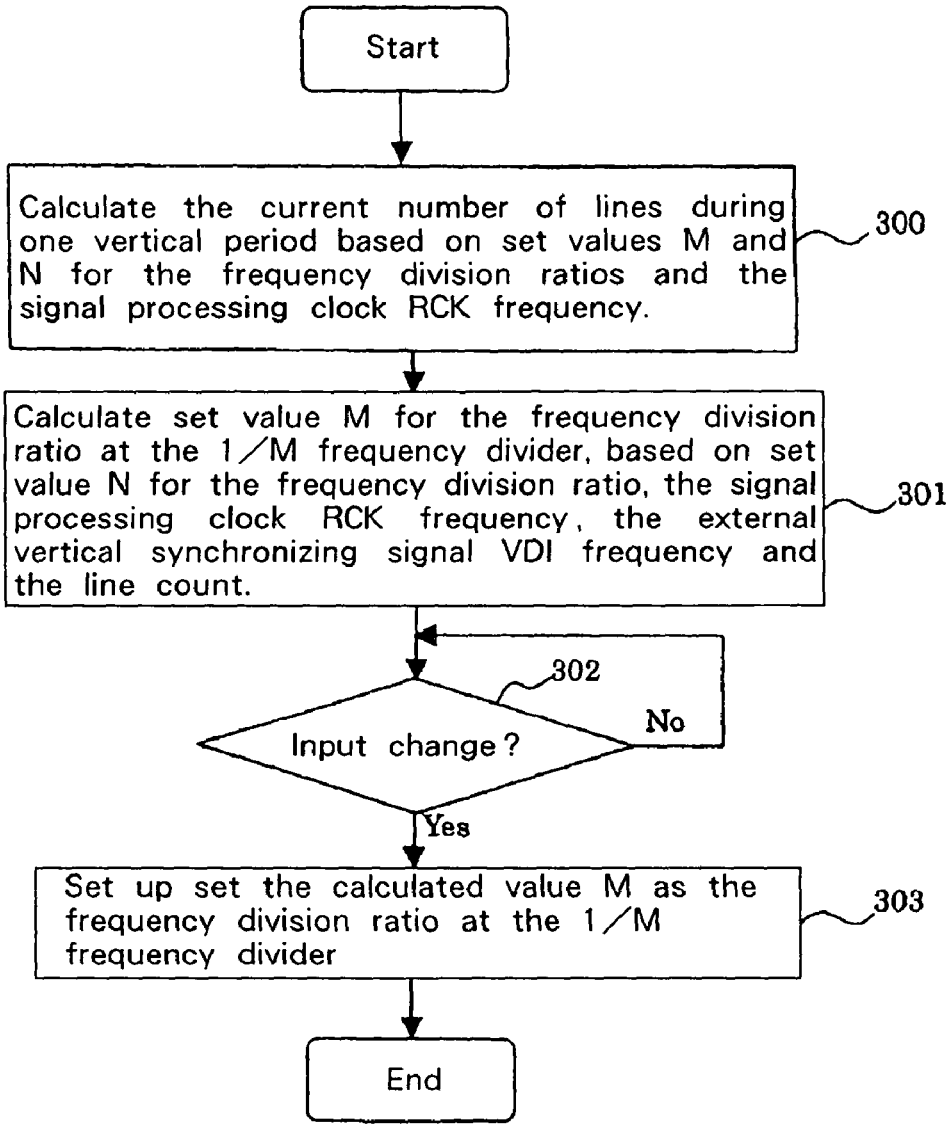
FIG. 3 is a flowchart showing a sequence of a horizontal frequency control process performed in the horizontal/vertical reference signal generating circuit shown in FIG. 1.

FIG. 3 shows a processing sequence of the horizontal frequency control process. First, based on a set values M and N for the division ratios at the frequency dividers and based on the frequency of signal processing clock RCK, which are stored in memory 108, line count L at present is calculated and the result is stored in memory 108 (Step 300). Subsequently, based on set value N for the division ratio at the 1/N divider, the frequency of the signal processing clock, line count L and the frequency of external vertical synchronizing signal VDI detected by frequency detecting circuit 106, frequency division ratio M1 of the 1/M frequency divider is calculated (Step 301). Then, it is determined whether input switching of switch circuit 104 (in this case, switch to external vertical synchronizing signal VDI) has been done (Step 302). If this determination is "Yes", the set value for the frequency division ratio at the 1/M frequency divider is altered to become the set value M1 for the frequency division ratio calculated at Step 301 (Step 303).

Here, when the input to switch circuit 104 is switched to the output from the 1/N frequency divider, the set value M (default) stored in memory 108 may and should be used.

In addition, though in the process shown in FIG. 3 the set value for the frequency division ratio at the 1/M frequency divider is altered in order to obtain a fixed number of lines, it is also possible to obtain a fixed number of lines by altering signal processing clock RCK instead. In this case, at Step 301, based on set value N for the division ratio at the 1/N divider, frequency division ratio M1 of the 1/M frequency divider, line count L, stored in memory 108, and the frequency of external vertical synchronizing signal VDI detected by frequency detecting circuit 106, the frequency of the signal processing clock is calculated. Then at Step 303, the frequency of the signal processing clock is modified so as to be the calculated value.

Next, operation of the liquid crystal drive circuit of the present embodiment will be described taking a specific numerical example.

In FIG. 4, specific examples of the numerals of signal processing clock RCK, set values (M, N) at the frequency dividers, horizontal reference signal RHD, vertical reference signals VDR, RVD, external vertical synchronizing signal VDI, line count (RHD/RVD) in four states, i.e., the first to fourth states, are shown.

The first state represents a state before switching the input to switch circuit 104, where the output (VDR) from vertical reference generating circuit 103 has been selected by switch circuit 104. Signal processing clock RCK is set at 75.8 MHz, set value M for the frequency division ratio is set at the 1/M frequency divider of horizontal reference generating circuit 102 is set at 1170, horizontal reference signal RHD is set at 64.8, set value N for the frequency division ratio is set at the 1/N frequency divider of vertical reference generating circuit 103 is set at 1080, output VDR from vertical reference generating circuit 103 is set at 60 Hz, and external vertical synchronizing signal VDI is set at 62.7 Hz. In this first state, since the output from vertical reference generating circuit 103 has been selected by switch circuit 104, vertical reference signal RVD is 60 Hz, and the line count (=RHD/RVD) is 1080.

The second state is a state where, in the first state, external vertical synchronizing signal VDI is selected for the input from switch circuit 103 without performing any horizontal frequency control process. In this second state, the frequency of vertical reference signal RVD from vertical reference generating circuit 103, which is equal to that of external vertical synchronizing signal VDI, is 62.7 Hz. As a result, the line count is 1033.

The third state represents a state in which, in the first state, the input from switch circuit 103 is switched into external vertical synchronizing signal VDI and a horizontal frequency control process is performed. In this third state, CPU 105, based on the frequency of external vertical synchronizing signal VDI detected by frequency detecting circuit 106, sets set value M for the frequency division ratio at horizontal reference generating circuit 102 at 1122. As a result, the frequency of horizontal reference signal RHD is 67.7 kHz and the number of the horizontal reference signals or the line count during one vertical period (=RHD/RVD) is 1080. In this way, when the frequency of vertical reference signal RVD is changed from 60 Hz to 62.7 Hz, by switching set value M for the frequency division ratio in the horizontal reference signal from 1170 to 1122, it is possible to make the number of horizontal reference signal lines during one vertical period constant.

The fourth state represents a state in which, in the first state, the input from switch circuit 103 is switched into external vertical synchronizing signal VDI and a horizontal frequency control process is performed. In this fourth state, CPU 105, based on the frequency of external vertical synchronizing signal VDI detected by frequency detecting circuit 106, sets signal processing clock RCK at 79.2 MHz. Also in this case, similarly to the above third state, the frequency of horizontal reference signal RHD is 67.7 kHz and the horizontal reference signal line count during one vertical period (=RHD/RVD) is 1080. In this way, when the frequency of vertical reference signal RVD is changed from 60 Hz to 62.7 Hz, by switching signal processing clock RCK from 75.8 MHz to 79.2 MHz, it is possible to make the number of horizontal reference signal lines during one vertical period constant.

As understood from the above first to fourth states, in the liquid crystal drive circuit of the present embodiment, if the frequency of vertical reference signal RVD changes as a result of a horizontal frequency control process, it is possible to keep the number of horizontal reference signal lines constant during one vertical period, hence the occurrence of a discontinuity in the liquid crystal drive timing signal can be avoid.

Figure 5A:
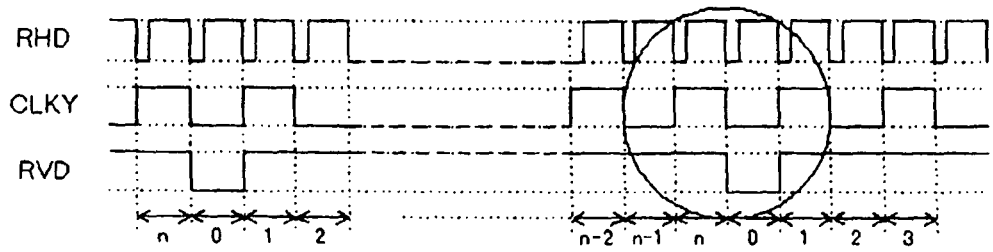
FIG. 5A is a time chart showing a liquid crystal drive timing signal in a normal state where the frequency of vertical reference signal RVD is unchanged.
Figure 5B:
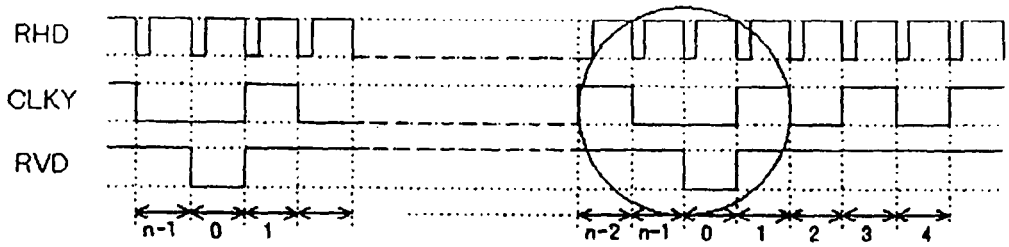
FIG. 5B is a time chart showing a liquid crystal drive timing signal in a case where the frequency of vertical reference signal RVD has been changed when no horizontal frequency control process is performed.
Figure 5C:
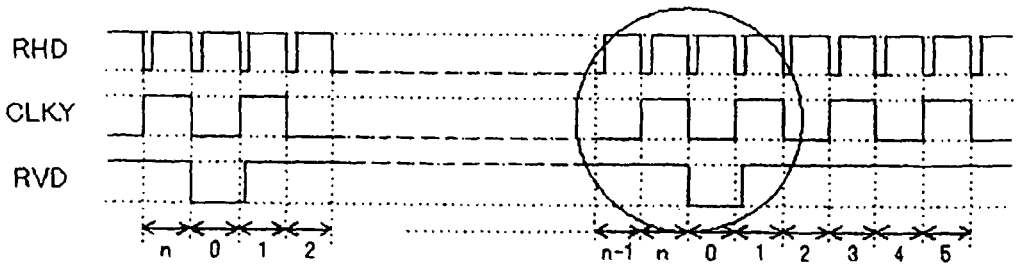
FIG. 5C is a time chart showing a liquid crystal drive timing signal in a case where the frequency of vertical reference signal RVD has been changed when a horizontal frequency control process is performed.

FIG. 5A shows liquid crystal drive timing signals in the normal state where the frequency of vertical reference signal RVD is constant. FIG. 5B shows liquid crystal drive timing signals in a case where the frequency of vertical reference signal RVD has changed when no horizontal frequency control process is performed. FIG. 5C shows liquid crystal drive timing signals in a case where the frequency of vertical reference signal RVD has changed when a horizontal frequency control process is performed. In FIGS. 5A to 5C, clock signal CLKY is a signal that repeats inversions for every period of horizontal reference signal RHD, and corresponds to a shift clock in the vertical direction. As shown in FIG. 5A, the normal state is so set up that no discontinuity will occur in the waveform of clock signal CLKY.

In the case where no horizontal frequency control process is performed, if the frequency of vertical reference signal RVD changes, a discontinuity occurs in the waveform of clock signal CLKY. For example, as shown in FIG. 5B if one RHD period of vertical reference signal RVD is lost as compared to the normal state, a discontinuity occurs in the waveform of clock signal CLKY (the portion encircled in FIG. 5B). When a discontinuity occurs in the liquid crystal panel drive signal, the line count in one vertical period changes so that it becomes impossible to perform stable image display. In the present embodiment, as shown in FIG. 5C, if the frequency of vertical reference signal RVD changes, it is possible to make the line count in one vertical period constant without causing any discontinuity in the waveform of clock signal CLKY as a result of the horizontal frequency control process.

As has been described heretofore, according to the liquid crystal drive circuit of the present embodiment, it is possible to make the line count in one vertical period constant without causing any discontinuity in the drive timing signal for the liquid crystal panel, by adjusting the oscillation frequency of clock generator 101 or the frequency division ratio at horizontal reference generating circuit 102 in accordance with changes in the frequency of the vertical reference signal, so that it is possible to realize stable operation of the liquid crystal panel.

The liquid crystal drive circuit of the above embodiment is one example of the present invention, and the configuration and operation can be changed as appropriate. For example, though, in the circuit shown in FIG. 1 the frequency of vertical reference signal RVD is adapted to change by switching between the input terminals of selection switch circuit 104, changes of the frequency of vertical reference signal RVD is not limited to this. For example, when a function such as fast forward play/rewind play etc., is performed in a VTR as an external appliance, the frequency of the synchronizing signal (external vertical synchronizing signal VDI) from the VTR varies, so that the frequency of vertical reference signal RVD changes. The operation when the frequency of external vertical synchronizing signal VDI has changed will be described next.

In a state where external vertical synchronizing signal VDI has been selected by switch circuit 104, when the frequency of the external vertical synchronizing signal VDI detected by frequency detecting circuit 106 changes, CPU 105 adjusts the oscillation frequency of clock generator 101 or the frequency division ratio setting at horizontal reference generating circuit 102 in accordance with that changes in frequency so that the line count in one vertical period will be unchanged. Specifically, as the frequency of external vertical synchronizing signal VDI changes from a first frequency to a second frequency, CPU 105, based on the second frequency, calculates the oscillation frequency of clock generator 101 or the set value for the frequency division ratio at horizontal reference generating circuit 102 so that a fixed line count is obtained. CPU 105 then modifies the oscillation frequency of clock generator 101 or the frequency division ratio at horizontal reference generating circuit 102 based on the calculated result. According to this arrangement, it is possible to keep the line count during one vertical period constant without causing any discontinuity in the drive timing signal for a liquid crystal panel even when the frequency of external vertical synchronizing signal VDI changes.

In the configuration shown in FIG. 1, frequency detecting circuit 106 may be disposed on the output line from switch circuit 104.

Though the above description has been made referring to a liquid crystal display device, the present invention should not be limited to the liquid crystal display device and can be applied to any type of display device as long as it is a display device in which drive timing signals for the display panel are generated based on a vertical reference signal and a horizontal reference signal. For example, the present invention can be applied to other displays such as plasma displays and the like.

While preferred embodiments of the present invention have been described using specific terms, such description is for illustrates purposes only, and it is to be understood that changes and variations may be made without departing from the spirit or scope of the following claims.

What is claimed is:

1. A display panel driver for a display panel on which an image frame is formed of a plurality of scan lines, comprising:

a drive timing signal generating circuit for generating a drive timing signal for driving the display panel, said drive timing signal based on a horizontal reference signal which will become a horizontal reference of a display period of every scan line and a vertical reference signal which will become a vertical reference of a vertical period as a display period of the image frame, said vertical reference signal being selected from between an internally generated signal and an external vertical synchronizing signal;

a controller which, when a frequency of the vertical reference signal has changed as a result of a selecting of said vertical reference signal, calculates a frequency of the horizontal reference signal that can keep a number of scan lines to be displayed during one vertical period at a predetermined count based on the changed frequency of the vertical reference signal, and which controls the frequency of the horizontal reference signal so as to be equal to the calculated frequency;

a clock generator for generating a clock signal;

a first frequency divider for dividing a frequency of the clock signal supplied from said clock generator to output a frequency-divided clock signal as the horizontal reference signal;

a second frequency divider for dividing a frequency of the frequency-divided clock signal supplied from said first frequency divider and outputting said divided frequency;

a switch circuit having one input terminal to which an external vertical synchronizing signal is supplied and having another input terminal to which the divided frequency signal from the second frequency divider is supplied and which selectively outputs one of said input terminals as the vertical reference signal; and a frequency detecting circuit for detecting a frequency of the external vertical synchronizing signal, wherein said controller, when a switching between the input terminals of said switch circuit is performed, alters one of an oscillation frequency of said clock generator and a frequency division ratio at said first frequency divider, and wherein, in a state where the external vertical synchronizing signal has been selected by said switch circuit, when said frequency detecting circuit detects changes in the frequency of the external vertical synchronizing signal, said controller then alters the oscillation frequency of said clock generator or the frequency division ratio at said first frequency divider.

2. A display panel driving method for a display panel on which an image frame is formed of a plurality of scan lines, said method comprising:

providing a terminal for receiving an external synchronizing signal;

generating a horizontal reference signal;

driving the display panel based on said horizontal reference signal which will become a horizontal reference of a display period of every scan line and a vertical reference signal which will become a vertical reference of a vertical period as a display period of the image frame, said vertical reference signal being selected from an internally generated signal and said external vertical synchronizing signal;

dividing a frequency of a clock signal generated by a clock generator at a first frequency divider to output a frequency-divided clock signal as the horizontal reference signal;

dividing the frequency of the output from said first frequency divider at a second frequency divider and outputting said divided frequency;

selecting one of inputs which includes an external vertical synchronizing signal and the output from said second frequency divider;

outputting the selected input as the vertical reference signal;

switching between the external vertical synchronizing signal and the output from said second frequency divider;

controlling the frequency of the horizontal reference signal by altering one of an oscillation frequency of said clock generator and a frequency division ratio at said first frequency divider;

in a state where the external vertical synchronizing signal has been selected, detecting changes in the frequency of the vertical reference signal;

controlling the frequency of the horizontal reference signal by altering the oscillation frequency of the clock generator or the frequency division ratio at the first frequency divider in accordance with the detected changes in frequency; and when a frequency of the vertical reference signal has changed as a result of a selecting of said vertical reference signal, calculating a frequency of the horizontal reference signal that can keep a number of scan lines to be displayed during one vertical period at a predetermined count based on the changed frequency of the vertical reference signal and controlling the frequency of the horizontal reference signal so as to be equal to the calculated frequency.

3. A video drive circuit for a video display device, said video drive circuit comprising:

a video signal processing circuit;

a scaling/FRC (frame rate converter) circuit;

a synchronization separation/PLL (phase lock loop) circuit comprising a clock generator for generating a system clock, an oscillation frequency of said system clock being variable;

a horizontal/vertical reference signal generating circuit comprising first and second frequency dividers, said first frequency divider dividing a frequency of the system clock supplied from said clock generator to output a frequency-divided clock signal as a horizontal reference signal, said second frequency divider dividing a frequency of the frequency-divided clock signal supplied from said first frequency divider and outputting said divided frequency;

a switch circuit having one input terminal to which an external vertical synchronizing signal is supplied and having another input terminal to which the divided frequency signal from the second frequency divider is supplied and which selectively outputs one of said input terminals as the vertical reference signal;

a frequency detecting circuit for detecting a frequency of the external vertical synchronizing signal; and a video display drive circuit, wherein:

said video signal processing circuit receives a video signal through a first input terminal and converts the video signal to output a digital signal, operation of said video signal processing circuit being synchronized with a system clock supplied from said synchronization separation/PLL circuit, said scaling/FRC circuit comprises a field memory for storing video data from said video signal processing circuit and obtains, by controlling a reading and a writing of data in said field memory, video data having a frequency and a resolution suitable for driving said video display, said synchronization separation/PLL circuit receives synchronizing signals through a second input terminal and generates synchronizing signals suitable for driving subsequent circuits, said horizontal/vertical reference signal generating circuit generates, based on the synchronizing signal from said synchronization separation/PLL circuit, said horizontal reference signal and said vertical reference signal which comprise a reference timing signal for operating said scaling/FRC circuit and said video display drive circuit, said horizontal/vertical reference signal generating circuit comprises a horizontal reference generating circuit formed of said first frequency divider dividing said system clock and outputting the output of the first frequency divider as said horizontal reference signal, a value of a frequency division ratio M of said first frequency divider is variable, said horizontal/vertical reference signal generating circuit further comprises a vertical reference generating circuit formed of said second frequency divider dividing said horizontal reference signal and outputting the output of the second frequency divider as a vertical reference signal, said video display driving circuit generates, based on the reference timing signal from said horizontal/vertical reference signal generating circuit, a drive timing signal for driving said video display, and converts digital video data output from said scaling/FRC circuit to a video signal suitable for display on said video display device, said drive timing signal being selected from either of said reference timing signal and an external reference signal, said scaling/FRC circuit functions such that when a switching between the input terminals of said switch circuit is performed, said scaling/FRC circuit alters one of an oscillation frequency of said clock generator and a frequency division ratio at said first frequency divider so as to keep a number of scan lines to be displayed during one vertical period at a predetermined count when a selecting of said drive timing signal is performed, and in a state where the external vertical synchronizing signal has been selected by said switch circuit, when said frequency detecting circuit detects changes in the frequency of the external vertical synchronizing signal, said scaling/FRC circuit then alters the oscillation frequency of said clock generator or the frequency division ratio at said first frequency divider.

4. The video drive circuit for a video display device according to claim 3, wherein said scaling/FRC circuit converts the digital signal into video data having the frequency and resolution suitable for driving said video display device.

5. The video drive circuit for a video display device according to claim 4, wherein if, as a result of a selecting of said drive timing signal, a vertical frequency of the drive timing signal changes, said horizontal/vertical reference signal generating circuit then adjusts the horizontal frequency according to the changed vertical frequency so as to keep a number of horizontal synchronization signals constant.

6. The video drive circuit for a video display device according to claim 5, wherein said number of horizontal synchronization signals corresponds to said predetermined count of scan lines.

7. The video drive circuit for a video display device according to claim 3, wherein a value of a frequency division ratio N of said second frequency divider is fixed.

8. The video drive circuit for a video display device according to claim 3, further comprising a CPU controlling a switching, between a first state in which a vertical reference signal is selected as an input and a second state in which a vertical synchronizing signal is selected as an input, so as to suppress an occurrence of a sideward shift of a video output signal.

9. The video drive circuit for a video display according to claim 8, wherein said vertical reference signal of said first state and said vertical synchronizing signal of second state comprise different vertical frequencies from each other.

10. The video drive circuit for a video display according to claim 9, wherein said suppression of a sideward shift of a video output signal comprises varying a frequency of a horizontal reference signal in accordance with a change in a frequency of the vertical reference signal.

11. The video drive circuit for a video display according to claim 10, wherein said varying of the frequency of the horizontal reference signal comprises changing a division ratio of a frequency divider dividing the system clock.

12. The video drive circuit for a video display according to claim 11, wherein said varying of the frequency of the horizontal reference signal comprises changing an oscillation frequency of the system clock.

* * * * *